US009070346B2

(12) United States Patent
Abiko

(10) Patent No.: US 9,070,346 B2
(45) Date of Patent: Jun. 30, 2015

(54) WHITE KEY FOR KEYBOARD INSTRUMENT

(71) Applicant: KABUSHIKI KAISHA KAWAI GAKKI SEISAKUSHO, Hamamatsu-shi, Shizuoka-ken (JP)

(72) Inventor: Masahiko Abiko, Hamamatsu (JP)

(73) Assignee: Kabushiki Kaisha Kawai Gakki Seisakusho, Hamamatsu-shi (JP)

( * ) Notice: Subject to any disclaimer, the term of this patent is extended or adjusted under 35 U.S.C. 154(b) by 94 days.

(21) Appl. No.: 13/964,799

(22) Filed: Aug. 12, 2013

(65) Prior Publication Data

US 2014/0083277 A1 Mar. 27, 2014

(30) Foreign Application Priority Data

Sep. 25, 2012 (JP) ..... 2012-211163

(51) Int. Cl.
*G10C 3/12* (2006.01)

(52) U.S. Cl.
CPC ..... *G10C 3/12* (2013.01)

(58) Field of Classification Search
CPC ..... G10C 3/12
USPC ..... 84/437, 433
See application file for complete search history.

(56) References Cited

U.S. PATENT DOCUMENTS 633,915 A * 9/1899 Smith ..... 84/436
4,512,234 A * 4/1985 Kumano ..... 84/433

FOREIGN PATENT DOCUMENTS

JP 2009-145731 7/2009

* cited by examiner

*Primary Examiner* — Jianchun Qin
(74) *Attorney, Agent, or Firm* — Christie, Parker & Hale, LLP

(57) ABSTRACT

A white key for a keyboard instrument, which makes it possible to improve yield and marketability and reduce manufacturing costs. The white key for a keyboard instrument includes a wooden key body, a synthetic resin-made upper cover bonded to the key body, and a synthetic resin-made front cover bonded to a front end face of the key body. The upper cover has a protrusion protruding downward from a front end thereof, and the protrusion and an upper end of the front cover are in contact with each other via respective inclined surfaces formed on the protrusion and the upper end of the front cover.

8 Claims, 4 Drawing Sheets

WHITE KEY FOR KEYBOARD INSTRUMENT

CROSS-REFERENCE TO RELATED APPLICATION

This application claims priority to and the benefit of Japanese Patent Application Number 211163/2012, filed on Sep. 25, 2012, the entire disclosure of which is incorporated herein by reference.

BACKGROUND OF THE INVENTION

1. Field of the Invention

The present invention relates to a white key for use in a keyboard instrument, such as a piano.

2. Description of the Related Art

Conventionally, as a white key for a keyboard instrument, there has been known one disclosed e.g. in Japanese Laid-Open Patent Publication (Kokai) No. 2009-145731. As shown in FIG. 6A, this white key 50 includes a wooden key body 51 and a synthetic resin-made key cover 52 bonded to the key body 51. The key cover 52 comprises an upper cover portion 52*a* that covers a portion of the key body 51 from a front end to a center or its vicinity of the key body 51, and a front cover portion 52*b* that covers a front end face of the key body 51. The front cover portion 52*b* is formed in a rib shape integrally with the upper cover portion 52*a* such that it extends perpendicularly downward from the lower surface of the upper cover portion 52*a*. With this, the upper cover portion 52*a* and the front cover portion 52*b* are formed to have an L shape in cross section.

In the case of manufacturing the white key 50 disclosed in Japanese Laid-Open Patent Publication (Kokai) No. 2009-145731, a manufacturing method described below is generally employed. First, there are made a wooden member (hereinafter referred to as "the key body member") which corresponds to a member integrally including key bodies 51 for one octave and a synthetic resin member (hereinafter referred to as "the key cover member") which corresponds to a member integrally including key covers 52 for one octave and is L-shaped in cross-section. Then, after bonding the key cover member to the key body member using a clamping press and a predetermined adhesive, and cutting is performed, whereby white keys 50 for one octave are manufactured. In doing this, in a case where the synthetic resin-made key cover member is made by a general injection molding method, since the key cover member has a structure in which the front cover portion 52*b* is formed in a lib shape integrally with the upper cover portion 52*a*, when the injection molded article is cooled, a sink (sink mark) 52*c* is sometimes formed at a portion where the two cover portions 52*a* and 52*b* are made integral with each other, as shown in FIG. 6B, or the front cover portion 52*b* is sometimes warped, as shown in FIGS. 6C and 6D. Further, although not shown, the front cover portion 52*b* is sometimes warped about the vertical axis thereof, or an insufficient filling condition, i.e. a short, can occur where a molding resin cannot reach a portion of a mold for injection molding corresponding to an extreme end of the front cover portion 52*b*. When such a sink, a warpage, or a short occurs, yield and marketability are lowered, which leads to an increase in manufacturing costs.

Further, the key cover member is formed in an L shape in cross section, and hence when bonding the key cover member to the key body member, it is difficult to cause the clamping press to apply uniform pressure to the entire key cover member, which tends to cause bonding failure. In this case as well, yield and marketability are lowered, which leads to an increase in manufacturing costs. Furthermore, for the same reason, the clamping press used for bonding becomes complicated in structure and increased in size, which causes a further increase in manufacturing costs.

SUMMARY OF THE INVENTION

It is an object of the present invention to provide a white key for a keyboard instrument, which makes it possible to improve yield and marketability and reduce manufacturing costs.

To attain the above object, the present invention provides a white key for a keyboard instrument, comprising a wooden key body, an upper cover attached to the key body in a manner covering a front portion of an upper surface of the key body, and a front cover attached to the key body in a manner covering a front end face of the key body, with an upper end thereof in contact with the upper cover.

According to this white key for a keyboard instrument, the two members, i.e. the upper cover and the front cover are configured to be attached to the key body. Therefore, even when the upper cover and the front cover are configured to be made of a synthetic resin, and a member integrally including upper covers for one octave (hereinafter referred to as "the upper cover member") and a member integrally including front covers for one octave (hereinafter referred to as "the front cover member") are made by injection molding, no sink mark is formed, or no warpage or short can occur, differently from the white key disclosed in Japanese Laid-Open Patent Publication (Kokai) No. 2009-145731 in which the upper cover and the front cover are formed integrally with each other. This makes it possible to improve yield and marketability and reduce manufacturing costs. Further, in a case where the upper cover member and the front cover member are made e.g. by injection molding, the shape of a metal mold for use can be simplified, which contributes to further reduction of manufacturing costs. Furthermore, the upper cover and the front cover can be made of respective materials different from each other, which contributes to improvement of marketability (note that throughout the specification, the term "wooden" is not limited to "made of wood, such as a solid wood material or plywood", but includes "made of a molding material, such as a particle board or an MDF").

Preferably, the upper cover has a protrusion protruding downward from a front end thereof, and the protrusion and the upper end of the front cover are formed with respective inclined surfaces sloping obliquely downward and rearward, with the protrusion and the upper end of the front cover being in contact with each other via the inclined surfaces.

With the arrangement of this preferred embodiment, the protrusion protruding downward from the front end of the upper cover and the upper end of the front cover are formed with respective inclined surfaces sloping obliquely downward and rearward, and the protrusion and the upper end of the front cover are in contact with each other via the inclined surfaces. Therefore, by making the uppermost edge of the inclined surface of the front cover coincident with the lower surface of the upper cover, it is possible to make a line where the front cover and the upper cover meet inconspicuous. Moreover, it is possible to prevent the key body from being seen through a gap between the two covers. As a consequence, it is possible to improve the appearance of the white key and further enhance marketability.

More preferably, the protrusion of the upper cover has a contact surface brought into contact with the front end face of the key body.

With the arrangement of this preferred embodiment, the protrusion of the upper cover is formed with the contact surface which is brought into contact with the front end face of the key body, so that in the case of bonding the upper cover member to a wooden member which integrally includes key bodies for one octave (hereinafter referred to as "the key body member"), it is possible to easily position the upper cover member with respect to the key body member simply by bringing the contact surface of the protrusion into contact with the front end face of the key body member. This facilitates the mounting operation, which makes it possible to further enhance marketability.

More preferably, the upper cover is made of a synthetic resin.

With the arrangement of this preferred embodiment, the upper cover is made of a synthetic resin. In this case, the protrusion of the upper cover is not required to cover the entire front end face of the key body, and hence it is possible to set the size of the protrusion to be much smaller than that of the front cover portion in Japanese Laid-Open Patent Publication (Kokai) No. 2009-145731. This makes it possible to make the upper cover having the protrusion e.g. by injection molding, without causing any sink mark, warpage, or short. As a consequence, it is possible to further enhance marketability.

Preferably, the upper cover and the front cover are both bonded to the key body.

With the arrangement of this preferred embodiment, the two members, i.e. the upper cover and the front cover are both bonded to the key body. Therefore, when bonding the two members to the key body member using e.g. a clamping press, it is possible to apply more uniform pressure to the upper cover member and the front cover member than in a case of the white key disclosed in Japanese Laid-Open Patent Publication (Kokai) No. 2009-145731. This makes it possible not only to appropriately bond the upper cover member and the front cover member to the key body member without causing bonding failure, but also to simplify the construction of the clamping press and reduce the size of the same. As a result, it is possible to further reduce manufacturing costs.

The above and other objects, features, and advantages of the present invention will become more apparent from the following detailed description taken in conjunction with the accompanying drawings.

BRIEF DESCRIPTION OF THE DRAWINGS

FIGS. 6A to 6D are side cross-sectional views of a conventional white key, in which FIG. 6A shows a key body and a key cover, FIG. 6B shows a key cover with a sink mark formed thereon, and FIGS. 6C and 6D show key covers with respective warpages.

DETAILED DESCRIPTION OF PREFERRED EMBODIMENTS

Figure 1:
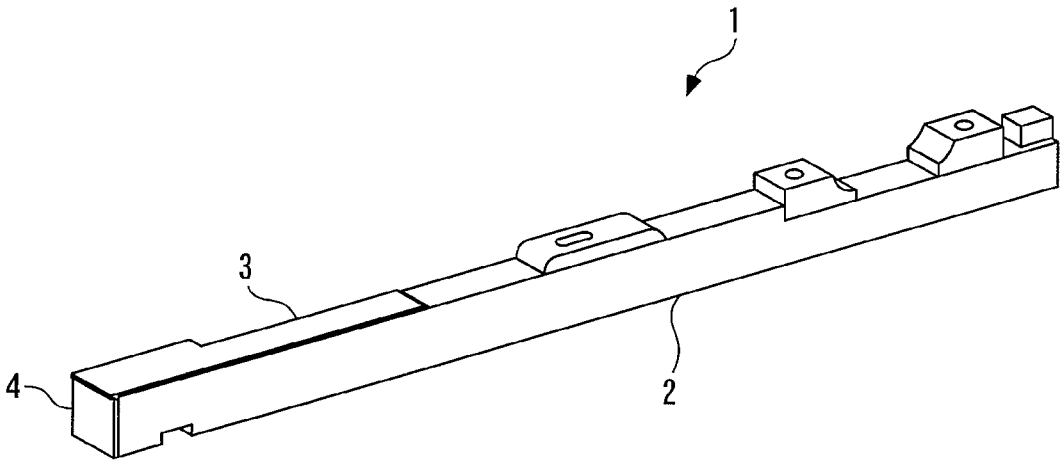
FIG. 1 is a perspective view of a white key for a keyboard instrument, according to one embodiment of the present invention.
Figure 2:
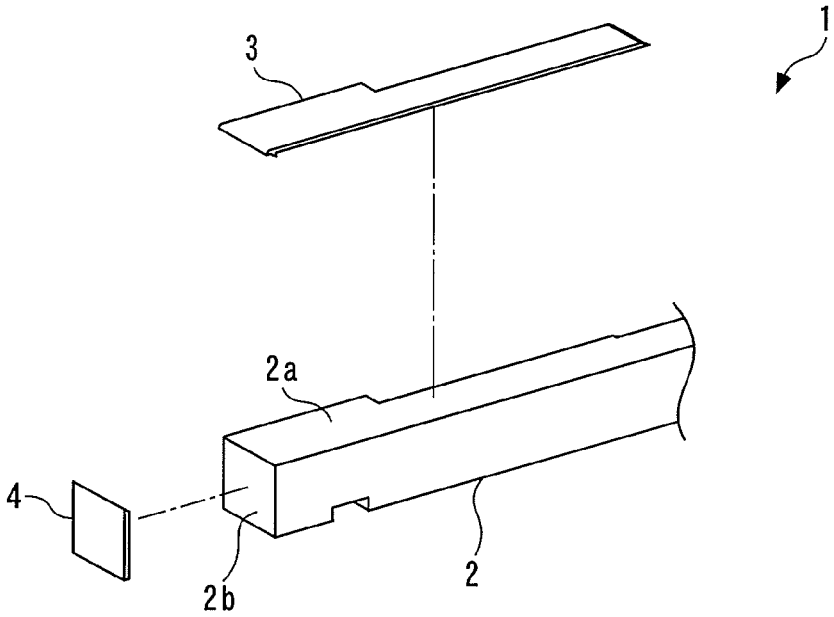
FIG. 2 is an exploded perspective view of a front portion of the white key.

The present invention will now be described in detail with reference to drawings showing a preferred embodiment thereof. A white key for a keyboard instrument, according to the present embodiment, is applied to an acoustic piano (not shown) as a keyboard instrument. As shown in FIGS. 1 and 2, the white key 1 includes a key body 2, and an upper cover 3, and a front cover 4 attached to the key body 2.

The key body 2 is a wooden member (made e.g. of spruce) which is square rod-shaped, and has an upper surface 2*a* including a flat portion extending from a front end to a center or its vicinity of the upper surface 2*a*. Further, the key body 2 has a front end face 2*b* formed as a flat square surface. The front end face 2*b* and the upper surface 2*a* are configured to be perpendicular to each other.

Figure 3:
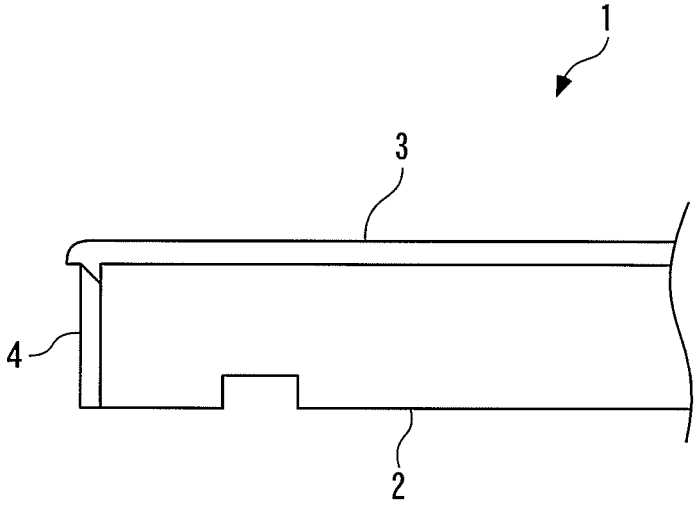
FIG. 3 is a side view of the front portion of the white key.
Figure 4:
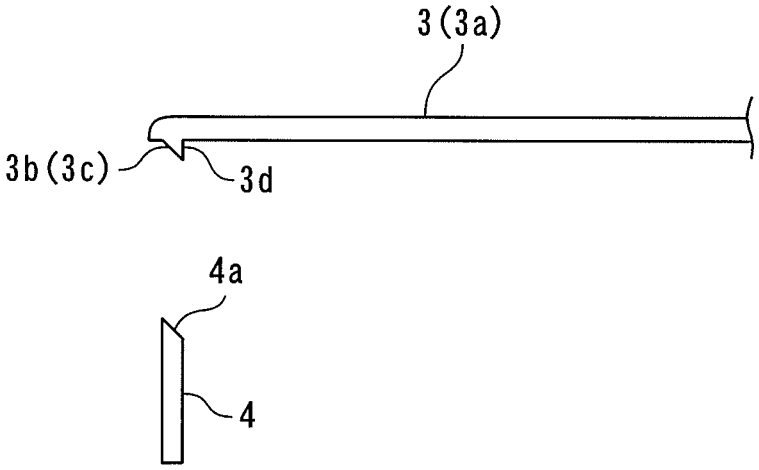
FIG. 4 is a side view of an upper cover and a front cover.
Figure 5:
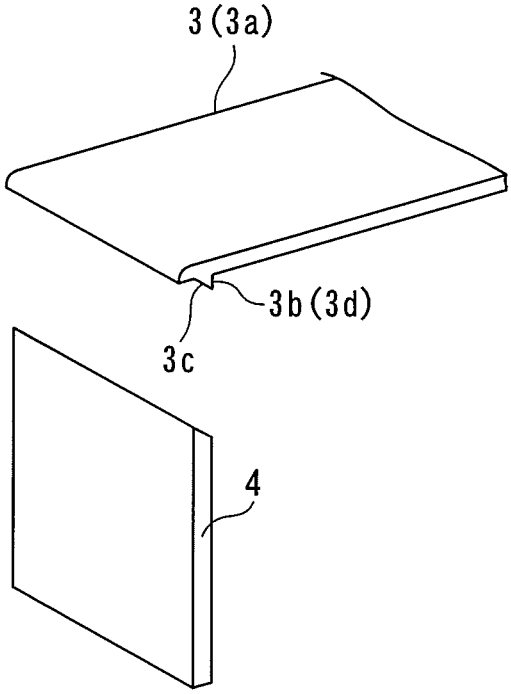
FIG. 5 is a perspective view of the upper cover and the front cover.
Figure 6A:
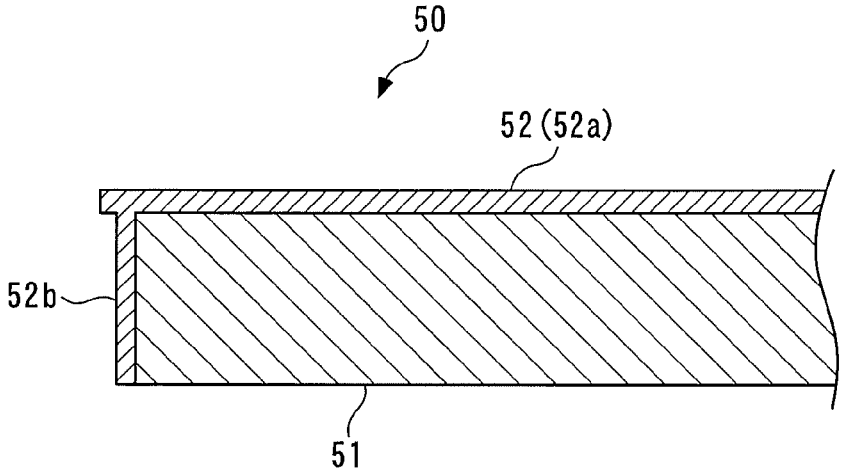
Figure 6B:
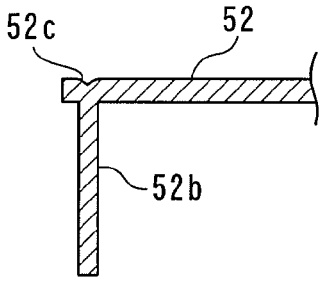
Figure 6C:
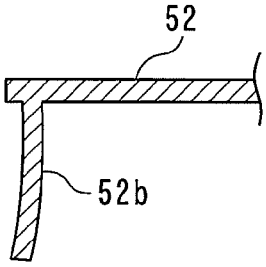
Figure 6D:
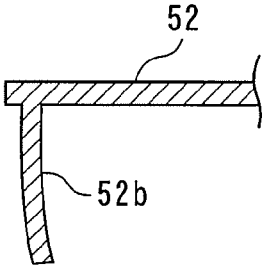

The upper cover 3 is in the form of a thin plate made by injection molding. The upper cover 3 is made of a synthetic resin having hygroscopic properties (e.g. a synthetic resin composited by dispersing inorganic whisker in cellulose acetate resin). As shown in FIGS. 3 to 5, the upper cover 3 comprises a base 3*a* in the form of a thin plate and a protrusion 3*b* protruding downward from the front end of the base 3*a*.

The protrusion 3*b* has a triangular shape in cross section. The protrusion 3*b* extends between the left and right ends of the upper cover 3, and has a front surface formed as an inclined surface 3*c*. The inclined surface 3*c* is formed in a manner extending obliquely downward and rearward at an angle of 45 degrees with respect to the lower surface of the base 3*a*. Further, the protrusion 3*b* has a rear surface 3*d* formed in a manner extending perpendicularly downward from the lower surface of the base 3*a*. The upper cover 3 is bonded to the key body 2 with the lower surface of the base 3*a* brought into surface contact with the upper surface 2*a* of the key body 2 without any clearance left and also with the rear surface 3*d* of the protrusion 3*b* held in surface contact with the front end face 2*b* of the key body 2 without any clearance left.

The front cover 4 is in the form of a thin plate made by injection molding, and has the same thickness as that of the upper cover 3. However, the front cover 4 is made of a different material of synthetic resin (e.g. an acrylic resin) from the material of the upper cover 3. The front cover 4 has an upper end thereof formed with an inclined surface 4*a*. The inclined surface 4*a* is formed in a manner extending obliquely downward and rearward at an angle of 45 degrees with respect to the front surface of the front cover 4. The front cover 4 is bonded to the key body 2 with the inclined surface 4*a* brought into surface contact with the inclined surface 3*c* of the upper cover 3 and also with the rear surface thereof brought into surface contact with the front end face 2*b* of the key body 2 without any clearance left.

The white key 1 is manufactured by a manufacturing method described hereafter. In the following description, neither a device used in the manufacturing process nor members being manufactured will be omitted. First, a plate-like member as a member integrally including upper covers 3 for one octave (hereinafter referred to as "the upper cover member") and a plate-like member as a member integrally including front covers 4 for one octave (hereinafter referred to as "the front cover member") are made by injection molding. Further, a wooden member corresponding to key bodies 2 for one octave (hereinafter referred to as "the key body member") is made.

Then, the upper cover member is bonded to the upper surface of the key body member using a clamping press. In this process, the rear surface of the protrusion 3*b* protruding from the lower surface of the upper cover member is brought into contact with the front end face of the key body member, whereby the upper cover member is positioned with respect to the key body member. Thereafter, the front cover member is bonded to the front end face of the key body member using the clamping press. Then, the assembly formed by bonding the upper cover member and the front cover member to the key body member is subjected to cutting, whereby white keys 1 for one octave are made.

According to the white key 1 of the present embodiment constructed as above, the upper cover member and the front cover member are separately made by injection molding as described above, and hence, differently from the white key in which the upper cover portion and the front cover portion are integrally formed as disclosed in Japanese Laid-Open Patent Publication (Kokai) No. 2009-145731, no sink mark can be formed and no warpage or short can occur in the upper cover 3 or the front cover 4 of the white key thus made. Particularly in the case of the upper cover 3, since the protrusion 3*b* is not required to cover the entire front end face 2*b* of the key body 2, it is possible to set the size of the protrusion 3*b* to be much smaller than that of the front cover portion disclosed in Japanese Laid-Open Patent Publication (Kokai) No. 2009-145731. This makes it possible to produce the upper cover 3 having the protrusion 3*b* e.g. by injection molding, without causing a sink mark, a warpage, or a short. This makes it possible to improve yield and marketability, and reduce manufacturing costs.

Further, both of the upper cover member and the front cover member are each formed to have a simple plate-like structure, and hence it is possible to make simpler the shape of a metal mold for use than in a case where the key cover L-shaped in cross-section is made as disclosed in Japanese Laid-Open Patent Publication (Kokai) No. 2009-145731. Furthermore, when bonding the upper cover member to the key body member, it is only required to simply press the plate-like upper cover member only from above the key body member using the clamping press, and hence it is possible to apply uniform pressure to the entire upper cover member. Similarly, when bonding the front cover member to the key body member, it is only required to simply press the plate-like front cover member only from front of the key body member using the clamping press, and hence it is possible to apply uniform pressure to the entire front cover member. This makes it possible not only to appropriately bond the upper cover member and the front cover member to the key body member without causing bonding failure, but also to simplify the construction of the bonding press and reduce the size of the same. As a result, it is possible to further reduce manufacturing costs.

What is more, when bonding the upper cover member to the key body member, it is possible to position the upper cover member with respect to the key body member by bringing the rear surface of the protrusion 3*b* protruding from the lower surface of the upper cover member into contact with the front end face of the key body member. This makes it possible to facilitate the mounting operation to thereby further enhance marketability. Further, the front cover 4 is attached to the key body 2, in a state where the uppermost edge of the inclined surface 4*a* of the upper end thereof coincides with the lower surface of the upper cover 3 and the inclined surface 4*a* is in surface contact with the inclined surface 3*c* of the protrusion 3*b* of the upper cover 3, and hence it is possible to make a line where the front cover 4 meets the upper cover 3 inconspicuous and prevent the key body 2 from being seen through a gap between the two covers 3 and 4. From the above, it is possible to improve the appearance of the white key, and further enhance marketability.

Although in the present embodiment, the white key of the present invention is applied to an acoustic piano as a keyboard instrument, this is not limitative, but the present invention can be applied to other keyboard instruments, such as an electronic piano and an electronic organ, which have white keys.

Further, although in the present embodiment, the upper cover 3 is made of a synthetic resin, this is not limitative, but the upper cover 3 may be made of any other material insofar as it can be attached to the key body in a manner covering the front portion of the upper surface of the key body. For example, the upper cover 3 may be made of ivory or ceramic. When ivory is used for the upper cover, the upper cover can be made by cutting.

Furthermore, although in the present embodiment, the front cover 4 is made of a synthetic resin, this is not limitative, but the front cover 4 may be made of any other material insofar as it can be attached to the key body in a manner covering the front end face of the key body. For example, the front cover 4 may be made of ivory or ceramic. When ivory is used for the front cover, the front cover can be made by cutting.

In the present embodiment, the upper cover 3 and the front cover 4 are made of respective different materials, but the upper cover 3 and the front cover 4 may be made of the same material.

Further, although in the present embodiment, the inclination angles of the inclined surface 3*c* of the upper cover 3 and the inclined surface 4*a* of the front cover 4 are both set to 45 degrees, the inclination angels of these inclined surfaces may be set to an angle other than 45 degrees. In this case, it is only required that the upper cover 3 and the front cover 4 can be bonded to the key body 2 such the two inclined surfaces 3*c* and 4*a* are in surface contact with each other without any clearance left.

It is further understood by those skilled in the art that the foregoing is a preferred embodiment of the invention, and that various changes and modifications may be made without departing from the spirit and scope thereof.

What is claimed is:

1. A white key for a keyboard instrument comprising:

a wooden key body;

an upper cover attached to said key body in a manner covering a front portion of an upper surface of said key body; and a front cover attached to said key body in a manner covering a front end face of said key body, with an upper end thereof in contact with said upper cover, wherein said upper cover has a protrusion protruding downward from a front end thereof, wherein said protrusion and said upper end of said front cover are formed with respective inclined surfaces sloping obliquely downward and rearward, and wherein said protrusion and said upper end of said front cover are in contact with each other via the inclined surfaces.

2. The white key as claimed in claim 1, wherein said protrusion of said upper cover has a contact surface brought into contact with the front end face of said key body.

3. The white key as claimed in claim 2, wherein said upper cover is made of a synthetic resin.

4. The white key as claimed in claim 3, wherein said upper cover and said front cover are both bonded to said key body.

5. The white key as claimed in claim 2, wherein said upper cover and said front cover are both bonded to said key body.

6. The white key as claimed in claim 1, wherein said upper cover is made of a synthetic resin.

7. The white key as claimed in claim 6, wherein said upper cover and said front cover are both bonded to said key body.

8. The white key as claimed in claim 1, wherein said upper cover and said front cover are both bonded to said key body.

* * * * *